United States Patent [19]

Greenwood et al.

[11] Patent Number: 4,624,522

[45] Date of Patent: Nov. 25, 1986

[54] RECEPTACLE FOR FLAT MULTICONDUCTOR CABLE

[75] Inventors: William S. Greenwood, Nutley; Karl Weinmann, Watchung; Reinhold Weindel, Clinton, all of N.J.

[73] Assignee: Thomas & Betts Corporation, Raritan, N.J.

[21] Appl. No.: 649,401

[22] Filed: Sep. 11, 1984

Related U.S. Application Data

[63] Continuation of Ser. No. 337,661, Jan. 7, 1982, Pat. No. 4,479,692.

[51] Int. Cl.[4] ..... H01R 4/24

[52] U.S. Cl. ..... 339/99 R; 339/14 R

[58] Field of Search ..... 339/14, 97 R, 97 P, 339/98, 99 R

[56] References Cited

U.S. PATENT DOCUMENTS 3,154,363 10/1964 Will ..... 339/99 R 3,177,457 4/1965 Croghan ..... 339/97 P

FOREIGN PATENT DOCUMENTS 620098 4/1927 France ..... 339/97 P

*Primary Examiner*—Joseph H. McGlynn

*Attorney, Agent, or Firm*—Robert M. Rodrick; Salvatore J. Abbruzzese

[57] ABSTRACT

A receptacle for use with flat conductor cable is provided with a grounding contact that can be urged into electrically conductive contact with the cable grounding conductor and protective shield on such cable independently of the means by which other contacts in the receptacle are urged into electrically conductive contact with the respective live and neutral conductors of the cable.

4 Claims, 6 Drawing Figures

RECEPTACLE FOR FLAT MULTICONDUCTOR CABLE

This is a continuation of application Ser. No. 06/337,661, filed Jan. 7, 1982, now U.S. Pat. No. 4,479,692.

FIELD OF THE INVENTION

The present invention relates to an electrical receptacle and, more particularly to a receptacle for use in making electrical connection with an insulated, flat multiconductor cable.

BACKGROUND OF THE INVENTION

Flat conductor cable (FCC) underlying carpet tiles is in present use to supply electrical power to various points of use, as for example, handling task lighting and appliance loads in commercial buildings. The flat conductor cable includes in a common form thereof a plurality of flat conductors i.e., live, neutral and grounding conductors encased in a plastic electrically insulative casing and additionally having a metallic shield disposed at the upper surface of the cable. A layer typically made of tough insulation material is provided on the bottom of the cable as an abrasion protection shield. The metallic shield is electrically grounded to provide against electrical hazard such as accidental piercing of the shield and the live conductor by an object. An advantage of the use of this type of conductor cable is the facility with which it can be installed beneath carpeting and carpet tiles while at the same time allowing for transfer of power therefrom at selected locations, pedestals or transfer receptacles being installed for such purpose.

Various specialized types of devices including receptacles are known for establishing power take-off from the flat conductor cable at a given location. Thus, for connecting a receptacle at a desired location, a terminal block carrying insulation piercing members or contacts can be secured over the flat conductor cable with the contacts piercing the flat conductor cable to establish continuity with the respective cable conductors. A receptacle can then be placed over the terminal block with suitable connection between the terminals of the block and contact points in the receptacle being made with round wire connectors. With such installation the cable run can be terminated at the take-off location or it may pass through the terminal block so that additional receptacles can be connected further down the line. It is also known to use for purposes of providing power take-off, a receptacle which embodies insulation piercing contacts therein and employed when installed directly over a conductor cable to have these piercing contacts electrically connectively engage the conductors in the cable.

One of the drawbacks of utilizing the types of devices described above for providing power take-off from a flat conductor cable is the difficulty of insuring positive and effectual maintenance of electrically conductive contact between the flat cable grounding conductor and the associated insulation piercing grounding contact in the terminal block if such is used, or between the cable grounding conductor and the associated insulation piercing grounding contact carried in the receptacle if that type of device is used directly on the cable. It is equally important to insure proper electrical contact between the grounding contact and any metallic grounding shield covering the cable. These prior art devices, be they terminal block or receptacle types produce contact between the insulation piercing contacts and the flat conductor cable conductors and any protective shield by pressure imparted from the terminal block in the one case or the receptacle body in the other, the pressure resulting from the tightening of fastening screws passing directly through the receptacle or fastening screws used to secure a base plate to the floor, which base plate in turn is used to clamp the terminal block securely in place over the flat conductor cable. Since it is commonplace to make the receptacle and the terminal blocks as one piece structures, and since it is commonplace to effect fastening at the ends thereof which are in regions immediately adjacent the flat conductor cable live and neutral conductors, such fastening can influence the degree of proper contact between the terminal block grounding conductor associated contacts or the receptacle grounding conductor associated contacts. Such influence is in spite of the fact that a further separate fastener may be used at a location centrally of the terminal block or receptacle, the region wherein the grounding contacts usually are carried in the terminal block or the receptacle. In fastening or clamping of prior terminal blocks or receptacles it is believed that such can produce a stress/strain condition in these structures causing them to bow upwardly slightly in the center and hence lessening the downward pressure imparted to the grounding contact at that location. Tightening of any centrally located fastening screw it is thought can be resisted by such a stress/strain condition sufficiently to impair the positive electrically conductive contact which should exist with respect to and between the receptacle or terminal block insulation piercing grounding contact on the one hand, and the cable grounding conductor and shield on the other.

SUMMARY OF THE PRESENT INVENTION

The present invention relates to improvements in receptacles used to provide a connection at a desired location to a flat conductor cable wiring system.

It is an object of the present invention to provide an improved form of receptacle for use with flat conductor cable embodying improved cable grounding conductor contact means as well as construction of the contact means and receptacle which assures effecting an optimal grounding continuity between such contact means and the flat cable grounding conductor and cable protective grounding shield.

Another object is to reduce the stress loading on the receptacle body produced by the installation screws with which the receptacle is secured in place at a pedestal location in a wiring circuit and the said screws are tightened forcing the receptacle downwardly against the cable to establish contact between the receptacle contact means and the cable conductors.

A further object is to provide a receptacle embodying an improved manner of arranging and retaining the contact means thereon.

In accordance with the present invention, an improved receptacle for use with flat conductor cable comprises an elongated receptacle body in which is carried contact means associated with the live and neutral conductors of the cable. The body is provided with a centrally located enlarged recess opening upwardly from the bottom thereof and which is receptive of a support block on which is carried the contact means associated with the grounding conductor of the cable.

Each receptacle contact means is provided with a first insulation piercing contact portion which is disposed at the underside of the receptacle body and a second contact portion extending upwardly in the body and adapted to be electrically connectively engaged by, e.g., appliance plug prongs, when the prongs are inserted into appropriate openings at the top side of the body. The receptacle is as will be understood from later given description, designed such that the insulation piercing contact portion of the grounding contact on the one hand, and the insulation piercing contact portion of the live conductor contacts on the other hand, can be urged into engagement with the respective associated cable conductors independently of each other. When installing the receptacle at a selected take-off location in the flat cable wiring circuit, the cable will be placed in overlying position on a support member which itself can be fixedly secured to, e.g., a floor. The metallic protective shield at the top side of the cable is removed from or cut back at selected locations over both the live and neutral conductors of the cable. The receptacle is then placed on top of the cable and secured at both ends thereof to the support member with screw fasteners, such action resulting in the downward urging of the receptacle against the cable and to the extent that the insulation piercing first portions of the live and neutral contact means at the bottom side of the receptacle body pierce the insulation covering the cable live and neutral conductors at the above-mentioned selected locations and are forced into electrically conductive contact with said conductors. The thus described securement of the receptacle over the cable can also have the effect of causing the insulation piercing first portion of the grounding contact means to pierce the cable protective shield remaining in overlying relation to the cable grounding conductor and to pierce the insulation covering said conductor as well. Since however, the integrity of the contact effected between the receptacle grounding contact means and the cable grounding conductor and protective shield must be maintained to assure essential and proper grounding circuit continuity and since the stress/strain effect created in the receptacle body by end securement thereof could thwart achievement of such assured contact, separate grounding fastening means is employed. The grounding fastening means such as a screw fastener connectable with the support member is received through an opening in the receptacle body and also passes through the support block carrying the receptacle grounding contact means with the screw fastener having an enlarged head which comes into abutment contact with the block. By fastening the screw to the support member, the support block and hence the grounding contact means first portion, since the support block is free to move up and down in the body recess, is forced into piercing contact through the protective shield and overlying insulation of the cable grounding conductor into firm contact with said conductor independently of the effect of any downwardly urging securement of the receptacle to the support member. There is thus achieved positive grounding circuit continuity among the cable grounding conductor, cable shield, receptacle grounding contact means and the grounding fastening means.

The live, neutral and grounding contact means second portions in the receptacle can be provided with two like branches so that the receptacle can be used for reception of two appliance plugs, each having a live, neutral and grounding prong.

In addition to its serving to carry the grounding contact means, the support block is used, due to the manner is which the live and neutral contact means are disposed in the receptacle, as a retainer to hold such live and neutral contact means securely in place.

The receptacle body in accordance with the present invention can be provided with features which insure that it will be properly oriented by the installer when it is placed on top of the flat cable at the time of securement to the support member thereby to insure that proper circuit polarity is maintained. Thus companion and cooperative telltale means can be provided on the receptacle and support member which, if not brought into proper installation alignment, precludes the installation screws passing through the receptacle from registering with the intended threaded receptive openings in the support member. Further the underside of the receptacle can be provided with downwardly depending tabs which can only be received in apertures in the support member if the receptacle is properly positioned.

The invention accordingly comprises the receptacle having the combination of elements and arrangements of parts as will be exemplified in the construction and description hereinafter set forth and the scope of the invention will be indicated in the claims.

BRIEF DESCRIPTION OF THE DRAWINGS

A fuller understanding of the nature and the objects of the present invention will be had from the following detailed description taken in conjunction with the accompanying drawings in which.

Throughout the description, like reference numerals are used to denote like parts in the drawings.

DESCRIPTION OF THE PREFERRED EMBODIMENTS

Figure 1:
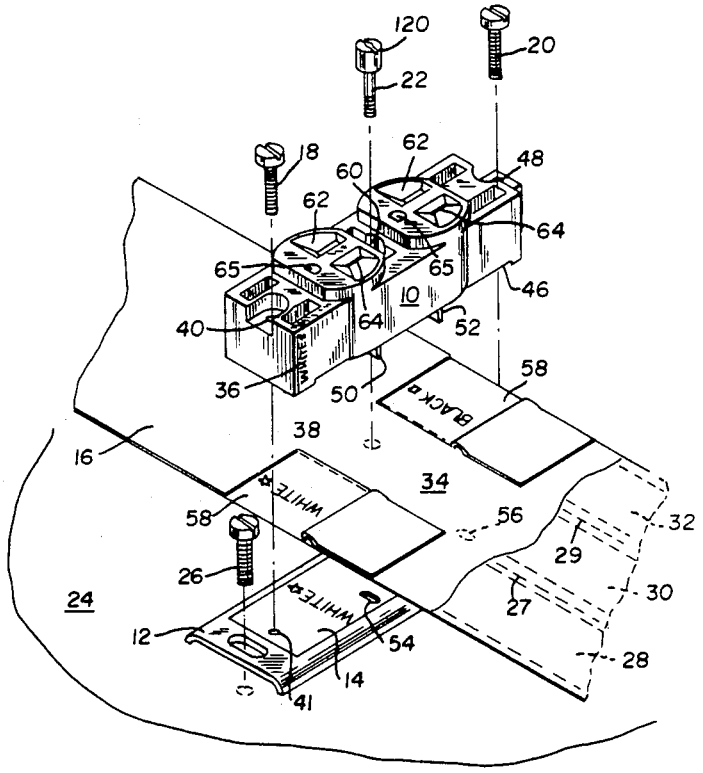
FIG. 1 is an exploded view in perspective showing the relative positioning of the components employed to effect pedestal installation for a flat conductor cable at a desired location, such components including the improved receptacle constructed in accordance with the present invention.

Referring to FIG. 1, the assembly of components used for installing a flat conductor cable receptacle 10 at a given location in a flat conductor cable wiring circuit includes in addition to the receptacle 10, a support member 12 including an insulated covering 14 preferably secured to the support member and the flat conductor cable 16 and the respective end fastener screws 18, 20 and a grounding fastener screw 22. Support member 12 with the insulated covering 14 is adapted to be secured to, e.g., a floor surface 24 with securement screws 26 at each end, only one such securement screw being shown in FIG. 1. Flat conductor cable 16 is of a known type, e.g., that disclosed in U.S. Pat. No. 4,219,928 and includes respective laterally spaced live, grounding and neutral conductors 28, 30, 32 encased in an insulative covering having perforations 27 and 29 separating the conductors and surmounted by a metallic protective shield 34. A layer of abrasion resistant material (not shown) is preferably on the bottom of the cable 16. The receptacle 10 carries indicia as at 36 which are cooperative with like indicia 38 on the cable indicative of proper receptacle orientation to insure correct polarity of electrical connections to be made. Further in this regard and to insure proper placement orientation of the receptacle on the cable, the receptacle has a fastener screw through passage 40 which functions as a telltale cooperative with like telltale openings 41 in insulated covering 14 and support member 12 when correct receptacle placement is effected to indicate such condition and thereby allow screw 18 to pass through for securement of the receptacle to the support member. As an additional feature designed to eliminate possibility of improper receptacle orientation on the cable, the side walls 42, 44 (FIG. 2) of the receptacle have their lower edges notched upwardly as at 46 for an intermediate distance between the receptacle ends with the termini of the notches in close fitting embrace with the opposite side edges of the cable and demarking the cable lateral extremities. One terminus of each notch is located closer to its associated receptacle end than the other terminus to its associated receptacle end. When therefore the receptacle is placed over the cable in correct orientation and hence proper polarity, the passage 40 will align with openings 41. If the receptacle was installed with a reciprocal orientation, the notches 46 would fit the cable snuggly but the passage 48 associated with fastener screw 20 would not align with openings 41 and screw 18 could not be inserted through the complete assembly. Notches 46 also accomodate the thickness of the flat cable and provide space in which the soon to be described receptacle insulation piercing contact means first portions are disposed. Another safeguard that insures that proper orientation must be employed to install the receptacle is provided by tabs 50, 52 at the underside of the receptacle which must pass through the cable preferably at the perforations 27 and 29 between the grounding conductor 30 and the live and neutral conductors and be received in openings 54, 56 in the insulated covering 14 and support member 12 in order for the receptacle to seat properly. If reciprocal orientation were attempted, the tabs would not line up with openings 54, 56 and hence not pass therethrough preventing proper seating. The receptacle is provided at the topside thereof with a generally centrally disposed passage 60 receptive of grounding fastening screw 22 and also with openings 62, 64 for receiving appliance plug prongs associated with power transfer, and openings 65 associated with the plug grounding prongs.

With continued reference to FIG. 1, the protective metallic or grounding shield 34 on top of cable 16 will as a preliminary to connecting the receptacle thereto be removed or cut and laid back in the rectangular pattern as at 58 in regions overlying the live and neutral conductors 28, 32 in the cable leaving exposed the insulative covering in which said conductors are encased. It is preferable that the shield be cut and laid back by folding same rightwardly on top of uncut portions of the shield since this facilitates effecting repair to the shield in the event the receptacle is removed. More specific consideration of receptacle 10 will be given next and with continuing reference to FIGS. 2–4.

Figure 6:
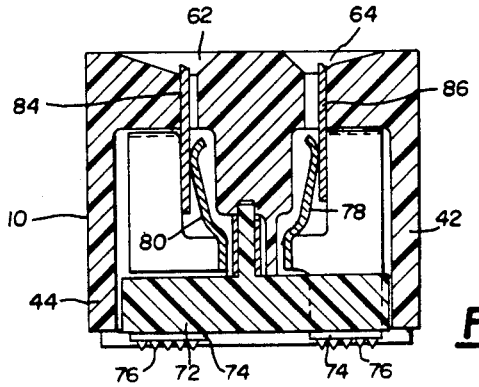
FIG. 6 is a transverse sectional view of the receptacle as taken along the lines VI—VI of FIG. 3.
Figure 2:
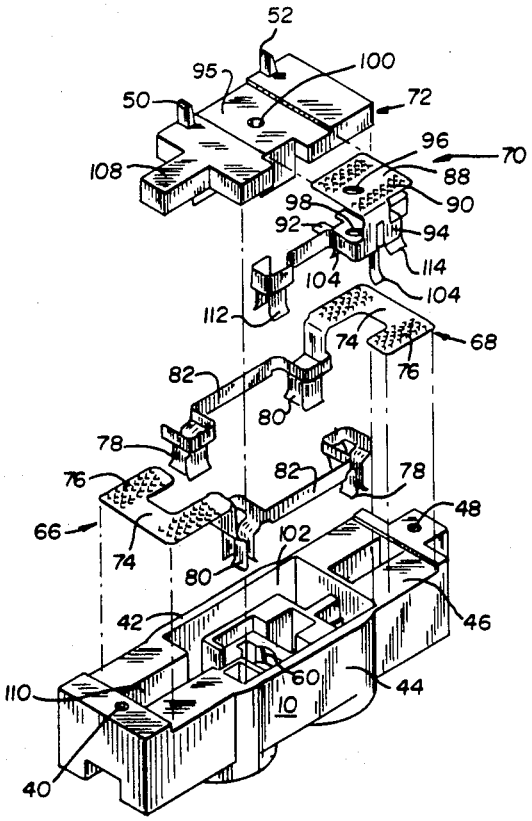
FIG. 2 is an exploded, bottom perspective view of the receptacle shown in FIG. 1 illustrating the support block and the cable live, neutral and grounding conductor associated contacts and the manner in which such contacts are positioned in the receptacle body.

Receptacle 10 is an elongated body made of electrically insulative material formed preferably as a molded structure of generally rigid durable character. Formed within the molded structure at the underside thereof are suitable conformably configured grooves for receiving the flat cable live conductor associated contact means 66 and the cable neutral conductor associated contact means 68. As FIG. 2 illustrates, the cable grounding conductor associated contact means 70 is carried on a support block 72 which shall be described in greater detail shortly. The contact means 66, 68 are identically configured members. Each of said contact means has a first contact portion 74 in the form of a thin broadened plate-like member and fitted with insulation piercing teeth 76 struck from the plate material in the manner, e.g., described in U.S. Pat. No. 3,549,786. The first portions of these contact means when such means are in retained position in the receptacle body are disposed at the underside of the receptacle and in facing relation to the flat cable on which the receptacle is positioned, the first portion of one contact means adjacent one end of the body and the first portion of the other adjacent the other body end. Each contact means also has a second contact portion which extends upwardly in the receptacle towards its top side and communicating with the body openings 62, 64. Such second contact portions desirably are formed as two like branches 78, 80 joined by a bus 82. The two branches of each of the respective live and neutral contact means cooperate to form two pairs of prong receiving contacts to transfer power to two appliances. FIG. 6 illustrates how these branches 78, 80 are disposed in the receptacle body and how two external power prongs 84, 86 of a plug are engaged therewith.

Figure 5:
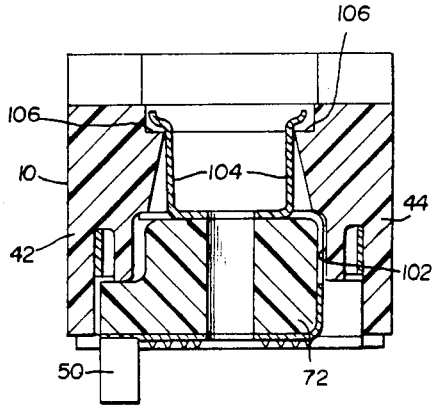
FIG. 5 is an enlarged view of the FIG. 4 illustration with the cover, screw fastener and support member removed.

FIG. 2 further shows that grounding contact means 70 is a single piece, shaped member having a first plate-like contact portion 88 also fitted with insulation piercing teeth 90, a spaced plate-like extension 92 joined by strut 94 to portion 88 and forming a skirt embracing the support block 72 with portion 88 being received in slot 95 of the block. Grounding contact means 70 also includes the like branch contact pieces 112, 114 which receive the grounding prongs on appliance plugs inserted into the receptacle, such contact pieces being in communication with body openings 65. This contact means also includes openings 96, 98 alignable with opening 100 in the block and through which openings the main shaft length of grounding fastener screw 22 passes. To accomodate support block 72, the receptacle body has an enlarged generally centrally disposed upwardly opening recess 102, the block closely fitting within the recess but yet being moveable upwardly and downwardly therein. For retaining the support block within the receptacle body, the grounding contact means is provided with flexible fingers 104 which extend upwardly in the body to engage with body detent shoulders 106 (FIG. 5) and hold the block captively but moveably retained in the receptacle body. Support block 72 also is provided at one end with a tongue-like extension 108 which is received in groove 110 of the receptacle body for properly orienting the support block when assembling same with the body, and also carries the alignment tabs 50, 52 referred to above and used in effecting alignment of the receptacle in proper orientation on the cable.

Figure 4:
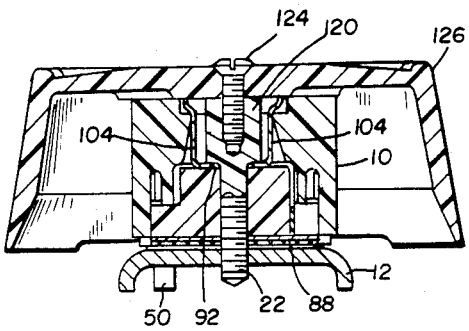
FIG. 4 is a transverse central sectional view in elevation of the receptacle as seen along lines IV—IV of FIG. 3 with the receptacle cover in place.
Figure 3:
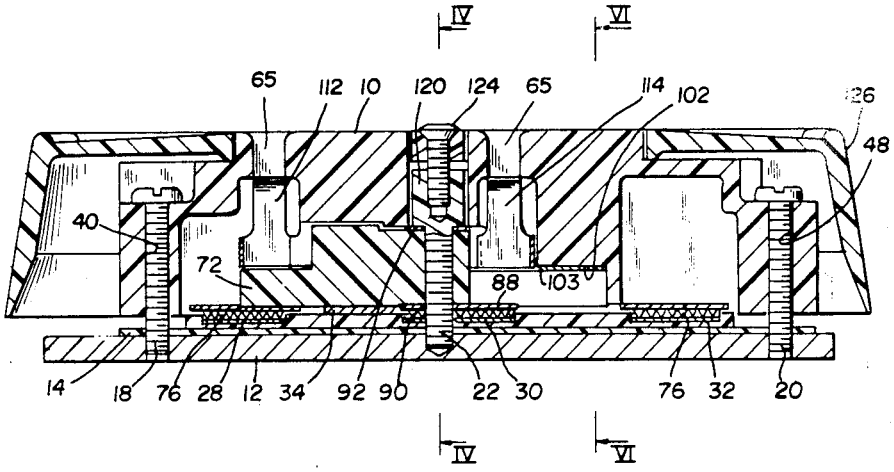
FIG. 3 is a longitudinal central sectional view in elevation depicting the manner in which the receptacle is connected to the support member and further the manner in which the grounding screw is employed to urge the grounding contact means into electrically conductive engagement with the cable grounding conductor, there also being shown a receptacle cover secured over the receptacle with a screw fastener received in the grounding screw.

When installing the receptacle and assuming that all preliminaries have been properly carried out inclusive of support member and insulating covering placement and shield lay-back, the receptacle having been properly oriented is placed on top of the cable, it is pressed down to cause tabs 50, 52 to penetrate and pass through the flat conductor cable at the perforations 27 and 29 and register in openings 54, 56 of the insulating covering. Fastening screws 18 and 20 are inserted through the respective openings 41, the openings 41 in support member being threaded, and ground fastening screw 22 is received in body passage 60. The tip end of screw 22 is of conical configuration to facilitate its penetration of the protective shield 34, cable insulative covering and the grounding conductor 30 itself. Screw 22 passes through the receptacle as seen in FIGS. 3 and 4 and its widened head portion 120 engages in stopped abutment with the support block 72 and grounding contact means extension 92, the openings 96, 98 and 100 being sufficient only to accomodate the narrower shaft portion of the screw. All of screws 18, 22 and 20 are made up tight and this results in forcing the receptacle downwardly against the cable. As illustrated in FIG. 3, sufficient downward pressure is involved to result in the teeth 76 on the first portions 74 of the respective contacts piercing the cable coverings and coming into good electrically conductive contact with the cable live and neutral conductors 28 and 32. Since the support block 72 is free to move independently of the receptacle body the grounding contact teeth 90 can be, by tightening screw 22, urged into optimum electrically conductive contact with the protective shield 34 and also the cable grounding conductor 30 independently of the downwardly urging pressure of the receptacle and created by tightening screws 18 and 20. Upon such tightening of the grounding screw 22, a spacing 103 preferably exists between the upper surface of the support block 72 and the bottom surface of the recess 102 of the receptacle 10 indicative of the independence of these components in assembly. There is thus assured establishment of continuity in the grounding circuit, since the grounding screw itself is in good electrically conductive contact with the contact means. The widened head part 120 of screw 22 can itself be tapped for reception of a screw 124 used to secure a cover 126 in place over the receptacle.

The advantages of the above-described receptacle construction are several and include:

1. The connection and continuity between the grounding contact and the protective shield and grounding conductor of the cable is not influenced by any stress and consequent strain and/or bending which might be created in the receptacle body by the tightening of the installation screws 18 and 20. Since the grounding contact is in the center of said receptacle body, it would be the most likely connection to be influenced by such a stress/strain condition.

2. The elimination of the loading points in the central portion of the receptacle due to the grounding screw, and the resultant forces exerted by the contact bearing aginst the receptacle body, serves to reduce the stress and bending reactions within said body. This results in a more stable assembly less likely to exhibit cracking and electrical connection degradation.

3. A safety feature is realized by having the grounding screw 22 bear directly upon the portion of the grounding contact directly above the contact establish teeth. It is, thereby, better assured that the grounding screw will always be at gound potential after it has been tightened to the proper installing torque. It is additionally assured that articles subsequently secured to the thread of the grounding screw, such as a metallic housing or cover, would also be at ground potential.

Various modifications to the foregoing particularly described receptacle will now be evident to those skilled in the art and may be introduced without departing from the invention. For example, the support block and grounding contact means in the receptacle could be urged into contact with the flat conductor cable by means other than the fastener screw 22. Thus instead of using a fastener screw connectable to the support member downwardly urging of the support block independently of the effect of securing the receptacle to said support member could be effected by using a pressure screw bearing against the top of the support block and carried in a threaded bushing fixed in the receptacle. Thus the foregoing preferred embodiments discussed and shown in the drawings are intended in an illustrative and not in a limiting sense. The true spirit and scope of the invention is set forth in the following claims.

We claim:

1. In a receptacle for use with flat elongate multiconductor electrical cable and adapted for placement on said cable in disposition spanning plural laterally spaced conductors extending longitudinally in said cable, including an elongated housing having a length at least sufficient to span the lateral expanse of said conductors in said cable, plural contact means supported by said housing associated separately with said cable conductors, said plural contact means being longitudinally spaced in said housing for individual lateral registration with respective cable conductors, each of said contact means having a terminal portion for external connection thereto and an insulation piercing portion disposed to pierce cable insulation and engage a respective conductor of said cable, and means for urging the insulation piercing portions of said contact means into engagement with the respective cable conductors, wherein the improvement comprises:

a conductive contacting member supported by said housing, said conductive contacting member being distinct from and disposed adjacent to a selected one of said contact means, said conductive contact member including an insulation piercing portion adapted to extend into insulation piercing relation with the same cable conductor to which said selected contact means is to be engaged, said urging means including a support member adapted for disposition underneath said flat cable and wherein said conductive contacting member insulation piercing portion has a threaded portion of extent to extend through said respective cable conductor and into threaded receipt in said support member, said selected one of said contact means including an opening through which said threaded portion of said conductive contacting member is received.

2. A receptacle for electrical connection to flat elongate multiconductor electrical cable and adapted for placement on said cable in disposition spanning plural laterally spaced conductors extending longitudinally in said cable, comprising:

an elongate housing having a length at least sufficient to span the lateral expanse of said conductors in said cable;

plural contact means fixedly retained in said housing and associated separately with said cable conductors, said plural contact means being longitudinally spaced in said housing for individual lateral registration with respective cable conductors, each of said contact means having a terminal portion for external connection thereto and an insulation piercing portion disposed to pierce cable insulation and engage a respective conductor of said cable;

means for urging the insulation piercing portions of said contact means into engagement with the respective cable conductors; and a conductive contacting member supported by said housing and movable relative thereto, said conductive contacting member being disposed adjacent to a selected one of said contact means, said conductive contact member including an insulation piercing portion adapted to extend into insulation piercing relation with the same cable conductor to which said selected contact means is to be engaged, but independently thereof.

3. A receptacle according to claim 2, wherein said urging means comprises a support member adapted for disposition underneath said flat cable and wherein said conductive contacting member insulation piercing portion has a threaded portion of extent to extend through said respective cable conductor and into threaded receipt in said support member.

4. A receptacle according to claim 2, wherein each of said plural contact means includes a plate-like member disposed at a lower surface of said housing and wherein said insulation piercing portions respectively project outwardly therefrom.

* * * * *